United States Patent [19]

Breton

[11] Patent Number: 4,816,684

[45] Date of Patent: Mar. 28, 1989

[54] HIGH-POWERED NEGATIVE ION GENERATOR IN A GASEOUS MEDIUM WITH A HIGH-STRENGTH ELECTRIC FIELD CONFIGURATION

[76] Inventor: Jacques L. G. Breton, 33600 Pessac, Pessac (Gironde), France

[21] Appl. No.: 89,646

[22] Filed: Aug. 25, 1987

[30] Foreign Application Priority Data

Aug. 29, 1986 [FR] France ..... 86 12448

[51] Int. Cl.[4] ..... H01T 23/00

[52] U.S. Cl. ..... 250/423 R; 250/423 P; 315/111.91

[58] Field of Search ..... 250/423 R, 423 F; 315/111.81, 111.91; 313/336; 361/230, 231

[56] References Cited

U.S. PATENT DOCUMENTS 3,665,241 5/1972 Spindt et al. ..... 250/423 R
4,227,894 10/1980 Proynoff ..... 361/231
4,721,885 1/1988 Brodie ..... 313/336
4,757,422 7/1988 Bossard et al. ..... 361/231

*Primary Examiner*—Carolyn E. Fields
*Assistant Examiner*—John A. Miller
*Attorney, Agent, or Firm*—Seidel, Gonda, Lavorgna & Monaco

[57] ABSTRACT

The invention relates to high-powered negative ion generator in a gaseous medium with a high-strength electric field configuration. This high-powered negative ion generator in a gaseous medium with a high-strength electric field configuration comprising two self-contained subsystems:

a source of very high negative dc voltage (THT) which is capable of supplying the current required for the second subsystem;

an electron optics unit comprising the points emitting electrons (Pte) and the various components (S1, P1, P2, P3) which cannot be separated and which create the configuration of the electric field required for the result it is desired to achieve.

6 Claims, 4 Drawing Sheets

HIGH-POWERED NEGATIVE ION GENERATOR IN A GASEOUS MEDIUM WITH A HIGH-STRENGTH ELECTRIC FIELD CONFIGURATION

The present invention relates to electronic apparatus of the "negative air-ion generators" type with which a strictly determined average atmospheric density of negative ions (simply ionised oxygen molecules) can be obtained within an enclosed space or premises without any production of ozone or nitrogen oxides.

The known apparatuses of this type are based essentially on "the point effect"; if it is raised to a negative potential of between 5 and 10 kV, a conducting point (normally made of metal) emits a more intense flow of electrons the greater the electric field in the vicinity of the point. These electrons are immediately captured by the oxygen molecules in the air and convert the latter into negative oxygen ions which have special physico-chemical and physiological properties.

These apparatuses nevertheless have several fundamental defects which restrict their performance and usefulness in particular for therapeutic applications:

- the generation of intense flows requires at the same time high voltages which are applied at numerous points and the configuration of the electric field obtained is then not very suitable for electron emission;
- compensation for the configuration fault is obtained by increasing the voltage applied to the points; this increase however is very soon limited by the threshold for the activation of the oxygen molecule into an ozone molecule which occurs in the region of 5 kV;
- this increase in voltage makes it necessary to put the points out of reach (safety of users) with insulating screens in which openings have been formed on an ad hoc basis; the surface charge which is taken on immediately by these screens creates an opposing electric field which considerably reduces the emitted and diffused flow;
- the space charge which is present in the vicinity of the point also has an opposing effect and reduces the ionic current which is really available; this results in an atmospheric density which is insufficient for the corresponding requirements.

These disadvantages can be completely avoided and these defects completely eliminated with the apparatus according to the invention.

This apparatus comprises in effect a number of long emitting points (which thus increase the field at their end) contained in an assembly of conducting and insulating diaphragms which constitutes the equivalent of an electron optics system which ensures the presence of a very intense electric field at the end of the points, an almost complete diffusion of the emitted electrons, the use of moderate voltages (of the order of 3.5 kV which is very much lower than the threshold for producing ozone), the application of as large a number of points as necessary, whereby the presence of safety insulating screens does not reduce in any measureable manner the initial flow of electrons; moreover a builtin fan provides effective filtering of the air let in onto the points and an excellent diffusion of the negative ions produced.

With the apparatus according to the invention, therefore, a flow of electrons (and consequently of negative oxygen ions into the atmosphere) which is as intense as considered necesary can be produced, emitted and diffused without having to use voltages of more than 4 kV and in this way by meeting the requirement for a complete absence of toxic compounds (ozone, nitrogen oxides) when the apparatus is to be used for a hygienic or therapeutic application.

This results in a decisive improvement in the "points generator" both from the power (emitted flow) point of view and from that of safety in use (low voltages, protective insulating screens), whereby these two parameters are no longer in opposition to each other.

The attached drawings show the following:

Figure 1:
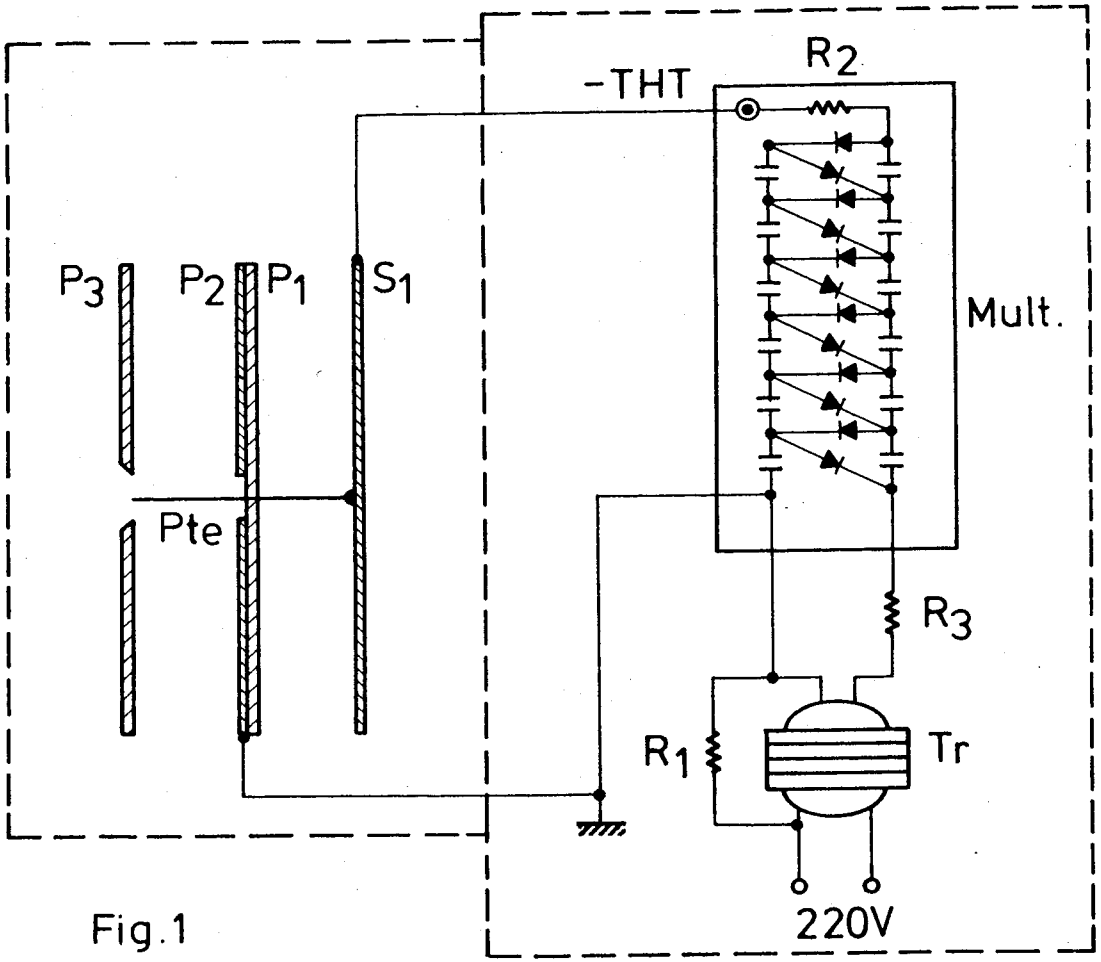
FIG. 1 shows a diagram (general view) of the apparatus indicating the basic functions carried out by each of its parts.

As shown in FIG. 1 (general view) the apparatus which is the subject of the invention comprises:

- a power supply (THT) for the emitting points (Pte), consisting of an isolation transformer (Tr) connected to the a.c. mains followed by a voltage multiplier (Mult) with diodes and capacitors; and "earth return" resistance (R1) defines the "zero" potential of the supply, whilst a protective resistance (R2) at the output of the multiplier restricts the accidential short-circuit current between points connected to the (−THT) and earth to a non-dangerous value;
- a conducting carrier plate (S1) on which are attached (by soldering, crimping, etc.) the emitting points (Pte);
- an insulating plate (P1) through which the emitting points (Pte) pass and which provides the attachment for these points and contributes to the configuration of the electric field in the vicinity of the carried points (Pte) and of the plate (S1) at (−THT);
- a conducting plate (P2), attached to the plate (P1) and completely covering the surface of this plate (P1) in which circular openings have been formed which are concentric with the points (Pte) and which ensures the optimum distribution of the equipotential regions but prevents any danger of arcing between the said points (Pte) and the said plate (P2) held at the "zero" potential of the earth;
- an insulating plate (P3) which can form the "casing" of the apparatus covered by the invention in which circular chamfered openings have been formed which are concentric with the emitting points (Pte) and which provides for the diffusion of the electrons emitted by the said points.

Figure 2:
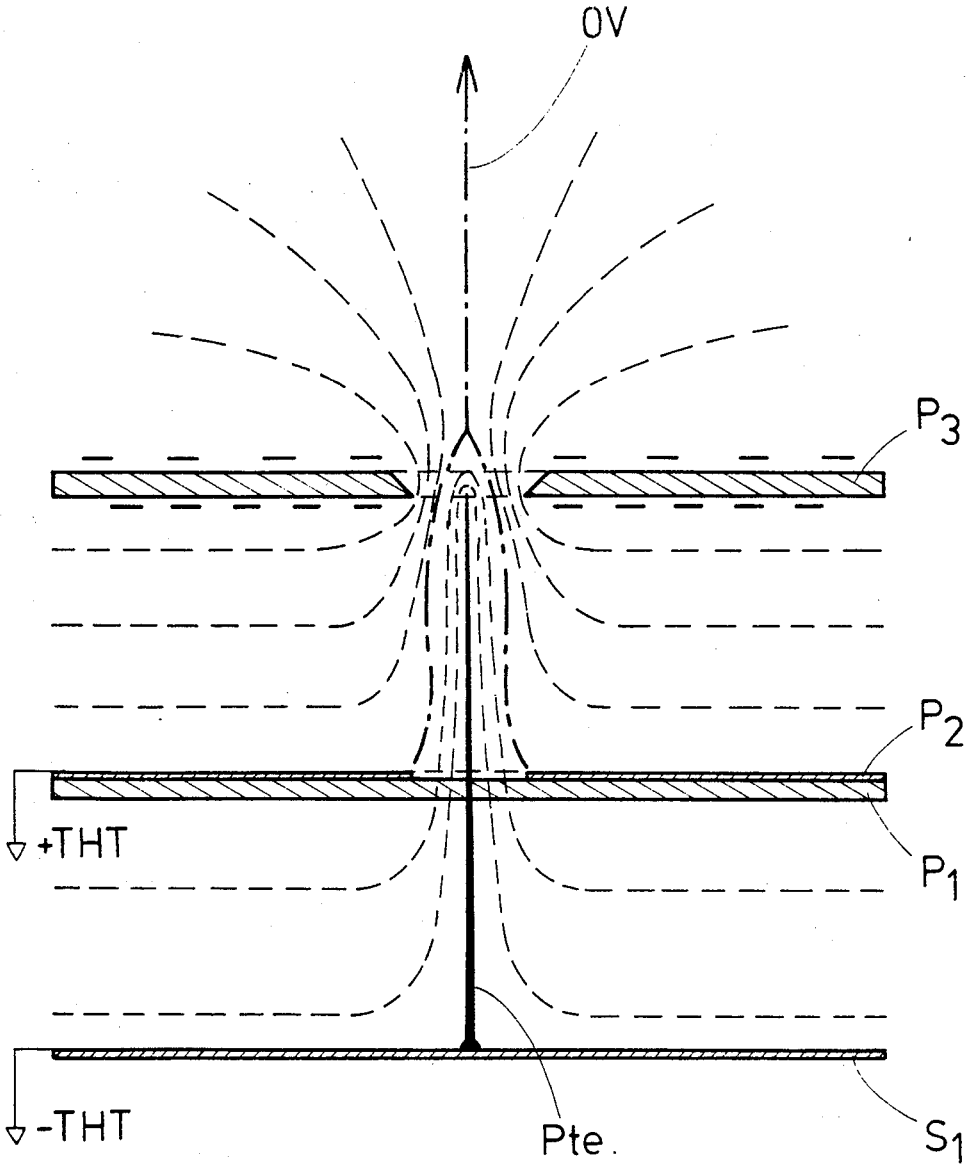
FIG. 2 shows a diagram of the components of the electron optics configuration, indicating the distribution of the equipotential regions and the electric field.
Figure 3:
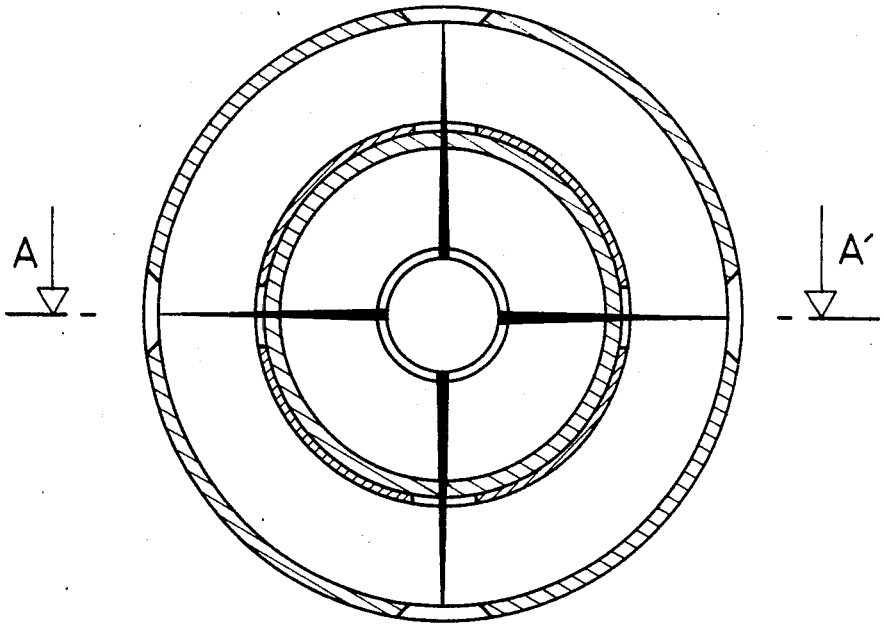
FIGS. 3 to 6 show a possible diagram in two configurations radial and axial for the diffusion of electrons; an example of this type which is non-restrictive does not in any way exhaust the possibilities of the invention which can be produced in a sperical, polygonal configuration etc. and be provided with all the characteristics which are peculiar to the new apparatus described.
Figure 4:
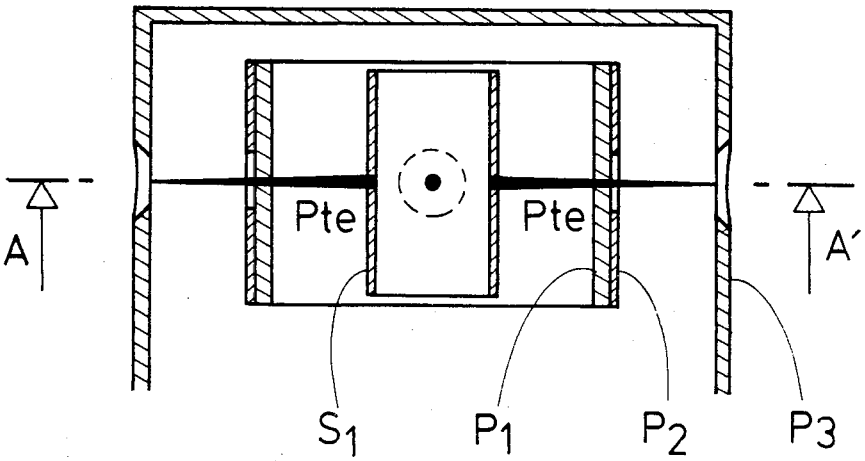

The drawing given in FIG. 2 represents the electron optics configuration which is designed for the complete diffusion into the surrounding atmosphere of the electrons emitted by the points (Pte). For this purpose a series of points (Pte) having a length at least equal to four times the diameter of the openings of the plate (P2) is attached to the conducting base (S1) whereby the whole system is raised to the potential (−THT) of the order of −3.5 kV; the conducting plate (P2) raised to the "zero" potential (earth, ground etc.) brings back therefore the corresponding "zero" equipotential region into its plane. This plane is located far to the rear of the end of the emitting points (Pte): the experimental measurements confirm the theoretical requirement for arranging the plate (P2) half way between the conducting plate (S1) and the free end of the emitting points (Pte). This arrangement then provides for the emission outwards of almost the complete flow of electrons produced (rate of more than 95%).

The "bringing back" of the "zero" equipotential region into very close proximity with the free end of the points (Pte) raised to −3.5 kV, creates a very intense local electric field at the end of these points giving a very high output for the emission towards the outside of the electrons extracted from the metal.

Moreover this very high local field reduces very considerably the space charge in the vicinity of the points and thus leads to a considerable improvement in the diffusion towards the free space.

This "bringing back" of the "zero" equipotential region also permits the use of as large a number of emitting points as is required without any appreciable reduction in the electric field in the vicinity of the points and consequently without reducing the overall output of the points which remains proportional to the output of a single point and the number of points used.

Finally the presence of the insulting screen (P3) and of its chamfered profile openings through the acquisition of a negative surface density, results in increasing the diffusion of the electrons which have passed through the said openings.

All the components (S1), (P1), (P2), (P3) and the points (Pte) located in the axis of the openings of the said components constitute therefore an electron optics system providing for the production, acceleration, focusing and diffusion in space of the electrons extracted from the metal of the said points under conditions which are close to the theoretical calculations.

An example of an application is given by the operation of the apparatus covered by the invention in places subject to atmospheric pollution by dust or fumes (tobacco or other fumes) and by injecting into such atmospheres a sufficient quantity of negative ions (greater than 5,000 ions/cm$^3$ at two metres from the points) these atmospheres can be "cleaned" by electrostatic precipitation towards the ground, the walls or any sensor provided for this purpose.

Another example of an application of the apparatus covered by the patent is its use in the biotherapeutic field in which advantage is taken of the known properties of the oxygen molecule which has been negatively ionized.

These examples of applications do not in any way exhaust the possibilities of the invention which can be used in any circumstances requiring the production of an intense flow of negative ions in a gaseous medium without any production at all of the toxic compounds represented by the ozone and the nitrogen oxides.

Figure 6:
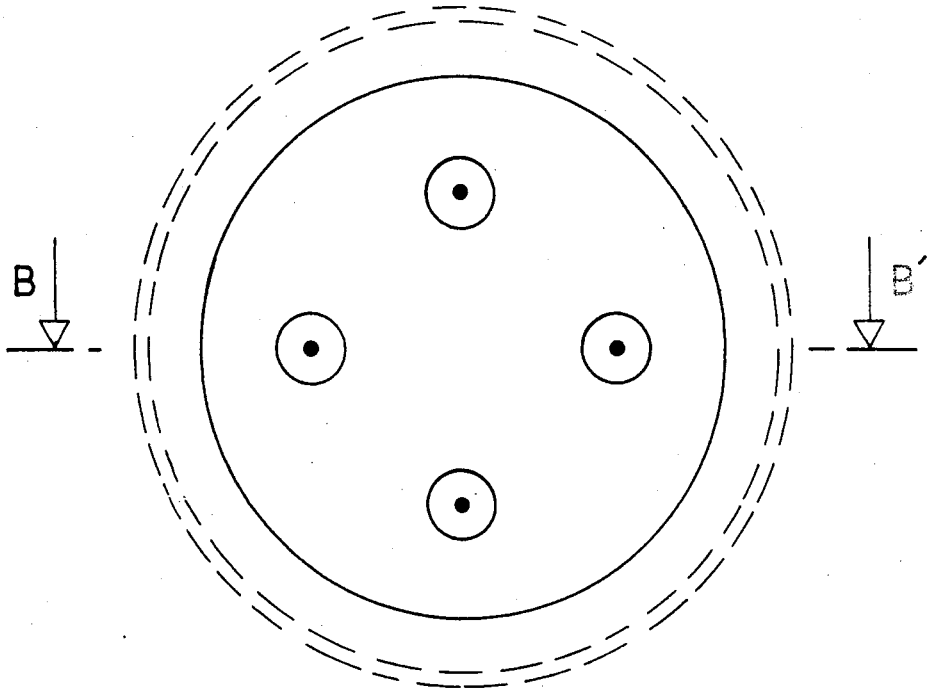
Figure 5:
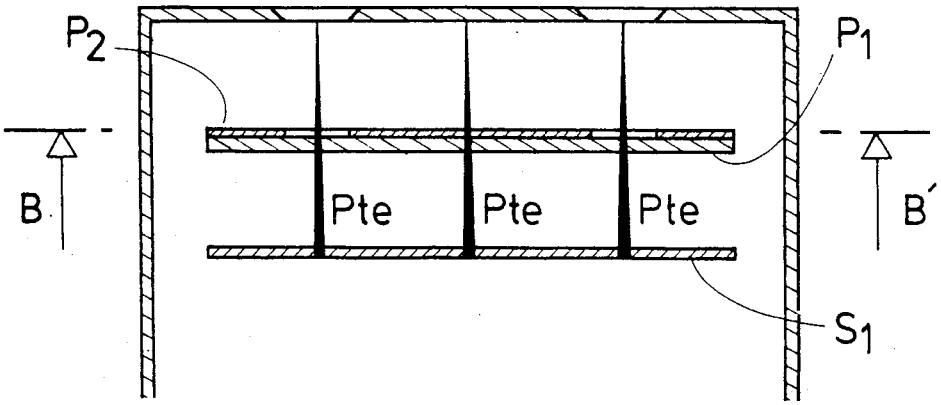

The drawings in FIGS. 5 and 6 represent an example of an embodiment of a generator of cylindrical form with upper axial emission;

- a transformer (Tr) with a high degree of primary/-secondary insulation (greater than a hundred megohms) makes it possible to provide at the secondary winding an effective voltage which varies between zero and 300 volts for an average power consumption of 5 watts;
- a voltage multiplier (Mult) comprising 12 Sescosem IN4007 controlled avalanche diodes with a 1200 Volt peak inverse voltage and a peak current of 1 ampere and 12 Wima capacitors of type FKP1, 10 nF, with operating voltages of 1600 volts d.c. and 500 volts a.c. The very high negative voltage (−THT) which is obtained can then vary between zero and −3500 V;
- a 20 megohms calibrated "earth leakage" (R1) resistance with a high degree of insulation between outputs which is connected between the primary and secondary windings of the transformer;

A secondary protection resistance (R3) located at the input of the multiplier of 22 kiloohms in ½ watts;

- an output (−THT) protection resistance (R2) of 10 megohms in ½ watts;
- a circular brass base (SL) of 6/10 mm in thickness and 160 mm in diameter including four soldered points (Pts) of 50 mm in length which makes up the first component of the electron optics system;

a circular plate (P1) made of rigid PVC of 3 mm in thickness and 160 mm in diameter which is used for positioning the points and which forms the second component of the electron optics system;

- a circular brass plate of 6/10 mm in thickness (P2) and 160 mm in diameter attached to the plate (PL) consisting of 4 circular openings which are concentric with the points of 11 mm in diameter, which form the third component of the electronic optics system;
- a circular plate (P3) made of rigid PVC of 3 mm in thickness and 160 mm in diameter, containing 4 circular openings which are concentric with the points, and which have a chamfered edge and a diameter of 10 mm at the base; this plate forms the fourth component of the electron optics system.

The plates (S1) and (P1/P2) are located at a distance of 25 mm from each other, whilst plates (P2) and (P3) are also located 25 mm from each other.

The flow of electrons emitted by a point at a voltage of 3.5 kV corresponds to a measured current of 3.0 microamperes; this measurement is taken between a point and a wide conducting plate placed 1.5 cm from the said point, which is the minimum distance required to prevent any arcing which would invalidate the measurement. This output corresponds to an average emission of $2.10^{13}$ electrons per second and per point (20,000 thousand millions).

It is clear that such an example of an embodiment does not in any way exhaust the possibilities of the invention which can effect an oscillator supply (THT) or any other equivalent source, provide an electron optics system in a radial arrangement (cylinder, sphere . . . ), as well as any other arrangement which meets the operating requirements of the said optics system.

I claim:

1. Apparatus for generating negative ions in a gaseous atmosphere, comprising:

(a) a source of negative voltage having a value sufficient to ionize gas molecules in said gaseous atmosphere wihtout otherwise altering the chemical identity of said molecules, (b) a plurality of elongated needle-shaped electrodes mounted at one end on a first conducting plate electrically connected to the source of negative voltage, (c) a first insulating plate spaced apart from the first conducting plate a distance equal to about half the length of the electrodes and through which the electrodes extend, said electrodes being in physical contact with the first insulating plate, (d) a second conducting plate on the surface of the first insulating plate opposite the surface facing the first conducting plate and having circular openings concentric with the electrodes through which the electrodes extend, and (e) a second insulating plate spaced a predetermined distance apart from the second conducting plate and having openings substantially concentric with the openings in the second conducting plate.

2. Apparatus according to claim 1, wherein means are provided to hold said second conducting plate at a potential of zero volts relative to the first conducting plate.

3. Apparatus according to claim 1 wherein said second insulating plate is spaced apart from the second conducting plate by a preselected distance such that the free ends of said electrodes lie approximately in the plane of the surface of the second insulating plate which faces the second conducting plate.

4. Apparatus according to claim 1, wherein said first and second conducting plates and said first and second insulating plates are generally planar.

5. Apparatus according to claim 1, wherein said first and second conducting plates and said first and second insulating plates are curved.

6. Apparatus according to claim 1, wherein said first and second conducting plates and said first and second insulating plates form concentric cylindrical sections.

* * * * *